United States Patent [19]

Pfenninger

[11] 4,175,382

[45] Nov. 27, 1979

[54] STEAM POWER PLANT WITH PRESSURE-FIRED BOILER

[75] Inventor: Hans Pfenninger, Baden, Switzerland

[73] Assignee: BBC Brown Boveri & Company Limited, Baden, Switzerland

[21] Appl. No.: 880,992

[22] Filed: Feb. 24, 1978

Related U.S. Application Data

[63] Continuation of Ser. No. 704,040, Jul. 9, 1976, abandoned.

[30] Foreign Application Priority Data

Aug. 22, 1975 [CH] Switzerland ..... 10896/75

[51] Int. Cl.[2] ..... F02C 9/04; F02C 9/14

[52] U.S. Cl. ..... 60/39.18 B; 60/39.25; 60/39.27; 60/39.29

[58] Field of Search ..... 60/39.18 B, 39.25, 39.27, 60/39.29, 664, 665, 667; 236/14

[56] References Cited

U.S. PATENT DOCUMENTS

| | | | |
|---|---|---|---|
| 1,927,204 | 9/1933 | Doble | 60/664 |
| 2,819,732 | 1/1958 | Paetz | 60/39.25 |
| 2,947,466 | 8/1960 | Busquet | 60/39.29 |
| 3,884,036 | 5/1975 | Pfenninger | 60/39.18 B |
| 3,896,623 | 7/1975 | Daniels | 60/665 |
| 3,908,897 | 9/1975 | Van Holtz et al. | 236/14 |

*Primary Examiner*—Robert E. Garrett
*Attorney, Agent, or Firm*—Burns, Doane, Swecker & Mathis

[57] ABSTRACT

A steam power plant equipped with a pressure-fired boiler which supplies steam to a turbine group includes a charging group for the boiler operating at high pressure ratios comprising a compressor driven by a gas turbine for supply fuel combustion air, the gas turbine being driven by combustion gas discharged from the boiler such that the heat content of the discharged combustion gas is substantially completely consumed in the turbine and the power delivered by it to the compressor. A governor in the live steam feed line from the boiler to the steam turbine group provides a signal by way of a primary control system that (1) regulates fuel flow to the boiler, (2) adjusts the compressor blading and (3) regulates a speed governor for the charging group, and a secondary control system provides a signal dependent upon the position of the speed governor that serves to regulate a bypass at the gas side of the boiler and therefore the amount of combustion gas delivered to the gas turbine. Operation of the control system for the power plant is such with a decrease in load, first the r.p.m. of the charging group is decreased followed by an adjustment of the compressor blading with the r.p.m. being held constant, whereas in the event of an increase in load, first the compressor blading is adjusted followed by an increase in r.p.m. of the charging group.

4 Claims, 2 Drawing Figures

Figure 1:
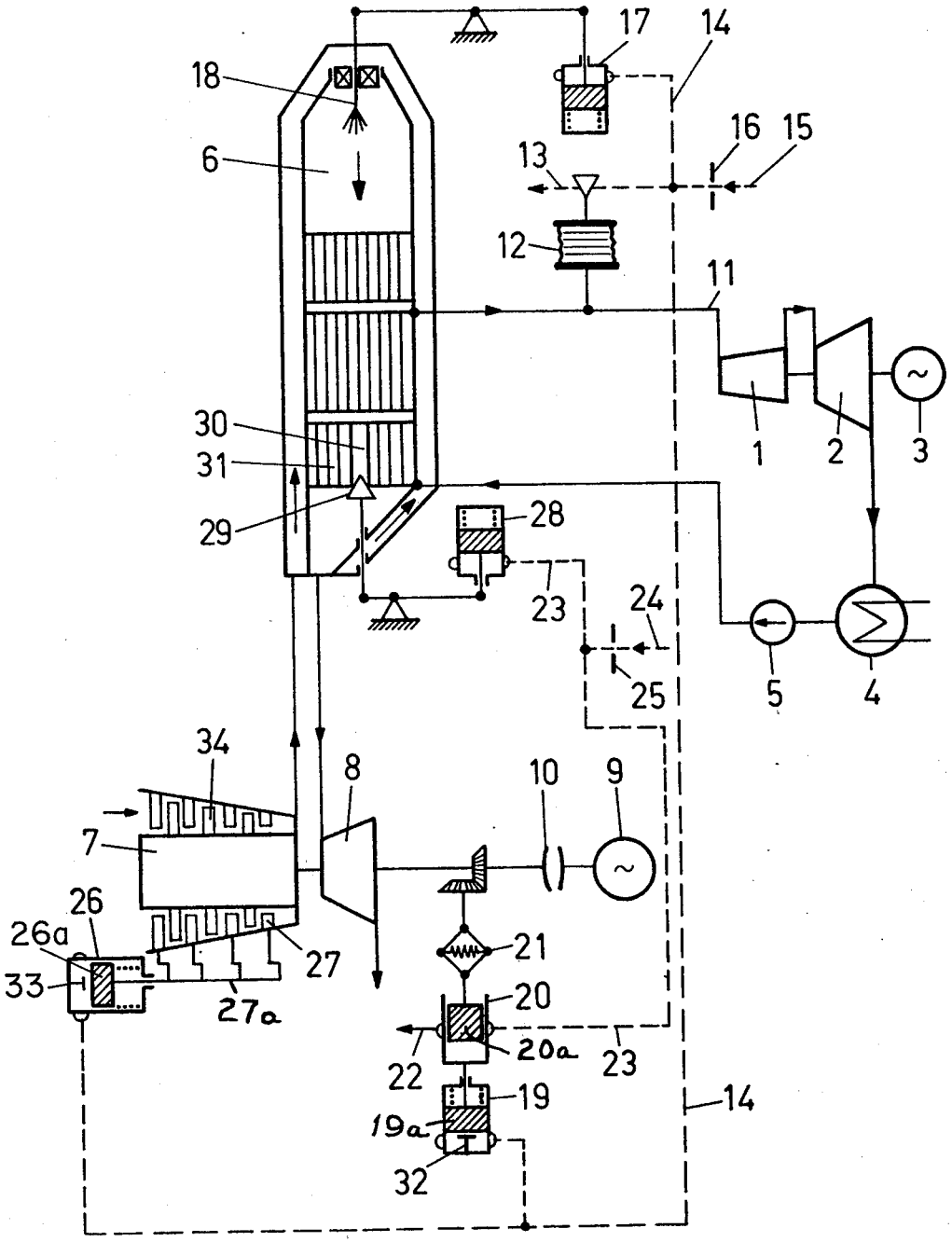

39
33
39a
35a
35
7
8
34a
27
34
33
26a
26
27a
14

STEAM POWER PLANT WITH PRESSURE-FIRED BOILER

This is a continuation of application Ser. No. 704,040, filed July 9, 1976, now abandoned.

This invention relates to an improvement in a steam power plant equipped with a pressure-fired boiler for supplying steam to a turbine group and in which the boiler receives air for fuel combustion and at a high pressure from a charging group operating at high pressure ratios comprising a turbo-compressor driven by a gas turbine for compressing the air, the gas turbine being driven by the combustion gases discharged from the boiler in such manner that the heat content in the discharge gases is substantially completely consumed in the turbine and the power delivered by the latter is just sufficient to meet the need of the compressor. A governor in the feed line from the boiler to the steam turbine group and which is responsive to live steam pressure or amount of steam flow provides a signal by way of a primary hydraulic or electrical control system which serves to regulate fuel flow to the boiler as well as regulate the turbocompressor and also a speed governor for the charging group, and a secondary control system provides a signal dependent upon the position of the speed governor which serves to regulate a bypass at the gas discharge side of the boiler and therefore the amount of combustion gas delivered to the gas turbine.

Pressure-fired boilers for steam power plants have been known for a long time under the trade name "Velox" and are in practical use. Associated with the charged boiler is a charging group where the air for combustion is compressed in a turbo-compressor, usually an axial flow compressor, up to the required combustion chamber pressure, and where the fuel gases upon leaving the boiler are expanded in a gas turbine driving the compressor. Systems of this type are especially of interest if the combustion chamber pressure exceeds 9 bar (see Swiss Pat. No. 552,770 and the corresponding U.S. Pat. No. 3,884,036 and where the turbine drives only the compressor. Under these circumstances the dimensions of the boiler on the one hand become smaller because the gas volume, due to the high pressure, is small and the coefficients of heat transfer are high and, on the other hand, the exhaust gas temperatures from the gas turbine will be low since the admission temperature to the gas turbine is low and the expansion drop high, so that there will be no need for the arrangement of subsequent heating surfaces.

However, the practical utilization of this specific design is limited because, as known, a turbo-compressor i.e. an axial flow type has only a narrow operating range and will quickly reach an unstable mode when its speed is reduced. The compressor pulsation limit is reached when the speed has dropped to 90% of the rated r.p.m. This inadequacy can be overcome to some extent by exhaust slots placed between the stator guide blades of the compressor but this expedient can never attain proper mechanical efficiencies at partial loads in the case of a high pressure ratio.

The principal objective of the invention to obtain a proper mechanical efficiency at partial loads for a steam power plant of the above discussed type, and especially for high pressure ratios present within the charging group.

The invention solves this problem in that the live-steam responsive governor, regulating the charging group will, in the case of a decreasing load lower first the r.p.m. of the charging group down to a predetermined magnitude, and will then adjust the blades of the turbo-compressor while the r.p.m. is held at a constant value, and will in the case of an increasing load first restore the blades to their former position and then raise the r.p.m. of the charging group.

A reduction in r.p.m. of the charging group has the effect that the gradient characteristic of the gas turbine will now deviate from its optimum value to a lesser degree, and its drop will also be less pronounced in the course of the subsequent adjustment of the compressor blades. Due to the reduction in the amount of combustion air attained thereby, the system will now operate more economically in the case of a partial load.

The attached drawings illustrate practical examples of the invention in diagram form and in a simplified manner.

Figure 2:
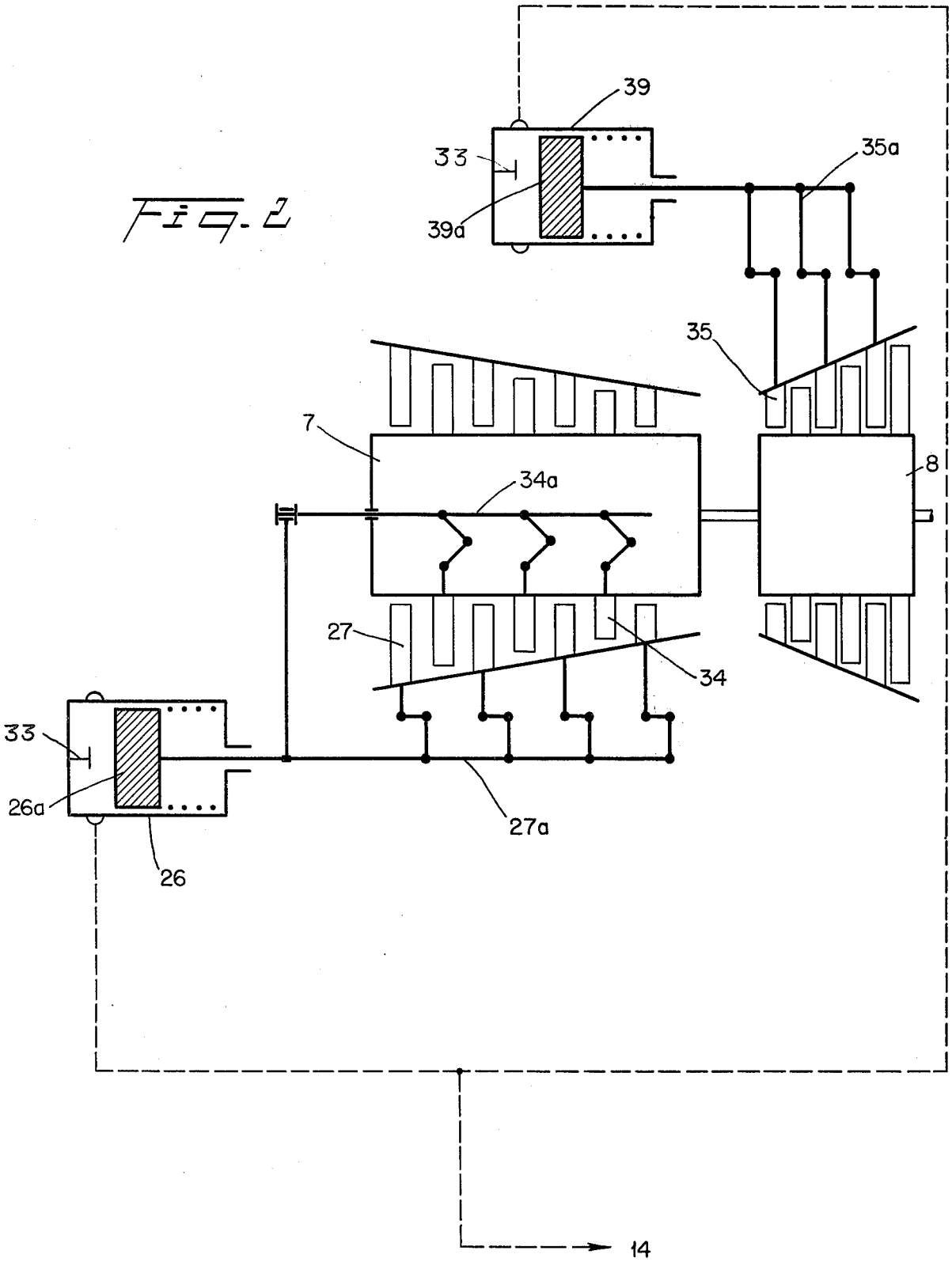

FIG. 1 illustrates an embodiment wherein only the stator blading of the turbo-compressor of the charging group is adjustable; and FIG. 2 illustrates a modification in which both the stator and rotor blading of the turbo-compressor component of the charging group as well as the stator blading of its axial flow driving turbine are adjustable.

With reference to FIG. 1 of the drawings it will be seen that the steam power plant consists primarily of a high-pressure steam turbine 1, followed by a low-pressure steam turbine 2, driving jointly an electrical generator 3, a condenser 4 at the discharge side of turbine 2, a condensation pump 5 following the condenser and a pressure-fired boiler 6 to which the condensate is returned. The charging group, comprised primarily of a turbo-compressor 7 i.e. axial flow type, a gas turbine 8, a starting motor 9 and a hydraulic coupling 10, serves the purpose of charging the boiler so as to bring it up to the desired pressure at the gas side. All components of this charging group are placed on one common shaft line.

Individual operating components provided for regulation of the power plant and which, as illustrated, are of the hydraulic type include:

a live-steam governor 12 which is responsive to the steam pressure or by the quantity of steam flow-through within a live-steam pipe 11 and which regulates oil outflow 13 (back to sump) from a pressurized oil pipe line 14 of a primary control system, the oil supply entering at point 15 and passing through a throttle unit 16. Connected to the pressurized oil pipe line 14 are a servo-motor 17 which regulates the (not illustrated) fuel supply by way of fuel nozzles 18 of the boiler 6, further a servo-motor 26 which adjusts the stator guide blades 27 of the turbo-compressor 7, by mechanism **27*a* and finally a servo-motor 19 which adjusts the cylinder 20 of a centrifugal governor 21 for the rotary charging group, thus also varying through a discharge outlet 22 back to sump the controlling oil pressure within a pressurized oil pipe line 23 of a secondary control system. The pipe line 23 is supplied with pressurized oil at point 24, with the oil passing through a throttling unit 25 and leads to a servo-motor 28 which actuates a valve 29 that regulates a by-pass 30 at the gas side of the boiler part 31 in accordance with a change in the position of governor 21**. In lieu of a hydraulic control i.e. the pressurized oil control illustrated, there can also be used an equivalent electric type of control with identical functions for the primary and secondary control systems.

The interaction of the various parts and the control and adjustment of the system has the following results:

The turbo-compressor 7 compresses the air for combustion at full load to at least 9 bar, thereby heating the air to approximately 330° C., and thus facilitating the combustion of the fuel oil. The boiler 6 is so designed that the gas temperature at its point of exit will be approximately 430° C., which is also the temperature of entry into the gas turbine 8. In view of the high pressure ratio, the final temperature of the exhaust gases leaving the gas turbine and thus also the flue temperature, will be only 150° C. Therefore the exhaust gas losses can be held to a low value and successively arranged voluminous heating surfaces will not be required. The turbo-compressor has no cooling whatsoever, and there is no need to heat the feed water return to the boiler by the compressed air or by the exhaust gas, thus allowing the optimum heating by bleeder steam.

By means of the control described below the temperature in front of the gas turbine is kept to a low value, just sufficient to drive the turbo-compressor of the charging group. As a result thereof, the entire expansion heat of the gas turbine, with the exception of losses due to friction and radiation, is transferred to the compressor so that the charging group will have the same effect as an exhaust-heated air preheater which is required in the case of the known systems. This group also generates at the same time a high pressure, reducing the heating surface of the boiler to a fraction of the heating surface needed by a boiler that is not supercharged.

The centrifugal governor 21 maintains a constant speed of the rotary charging group within its margin of cyclic variation, for example in such manner that upon a drop in speed of the charging group the control piston 20*a* within cylinder 20 will close off its outlet, thereby opening the by-pass valve 29 by reason of the increase in pressure within oil pipe line 23 of the secondary system and the servo-motor 28 which it controls, the servo-motor 28 being operatively connected to valve 29. This will cause the temperature in front of the gas turbine 8 to rise and the speed of the charging group is thus kept within the cyclic variation of the governor.

To make it possible to reduce the r.p.m. of the charging group at a partial load—which is advantageous in that the amount of the air for combustion can be adjusted in any given case in accordance with the load of the boiler or the quantity of fuel respectively—the starting motor 9 is shut down and separated from the charging group by disengaging clutch 10 as soon as the charging group has reached, after ignition of the combustion chamber, the r.p.m. necessary for the stability of compressor and gas turbine output. It is now subject only to the controls installed. The subsequent adjustment of the stator guide blades of the compressor allows a reduction in the amount of combustion air necessary to approximately 55%, with the result that the excess air amount in the boiler at full load and down to half load can, for all practical purposes, be held constant which is of utmost importance for a proper and clean combustion and reduction in fouling of the environment.

For example, if the machine is close to full load and the live-steam pressure is rising because the steam turbine group requires a lesser amount of steam due to a power drop, the live-steam governor 12 will open the outlet 13 of the pressurized oil pipe line 14. As a result thereof the oil pressure within the primary control system will drop and close by means of the servo-motor 17 the fuel nozzles 18 of the boiler. At the same time the cylinder 20 of the centrifugal governor 21 is shifted by the servo-motor 19 in such manner that the outlet 22 is moved to a more open position, thereby lowering the controlling oil pressure within the pressurized oil pipe line 23 of the independent secondary system. As a result of this action, the servo-motor 28 will move valve 29 to a more closed position, and thereby also the by-pass 30 at the gas side of the boiler to a more closed position. The temperature in front of the gas turbine will now drop and the r.p.m. of the charging group and the quantity of the produced air for combustion respectively, are now adjusted to match the now, smaller amount of fuel.

If the load, and as a result thereof the pressure within the primary control system, continues to drop, the control piston of servo-motor 19 can move only as far as its stop 32. The lowermost position of the cylinder 20 is then reached, and the r.p.m. of the charging group can not decrease any further.

By dimensioning the spring forces in the servo-motors in a proper manner, the servo-motor 26 can be actuated only after the piston of the servo-motor 19 has reached its terminal position. When the pressure within the pipe line 14 continues to drop, the position of the piston 19*a* of servo-motor 19 will no longer change as explained above, but now the piston 26*a* of servo-motor 26 will move and adjust the stator guide blades 27 of the compressor 7 until here again a maximum of adjustment is reached at the stop 33 for servo piston 26*a*.

If the live-steam pressure decreases temporarily, i.e. in the case of a rising load, a similar controlling process will take place, but with the steps being reversed. First, the guide blades 27 of the compressor are adjusted, to be followed by an increase in r.p.m. of the charging group.

When the above described controlling steps are taking place, the r.p.m. of the charging group will reach its lowermost limit at approximately 90% of the rated load. Upon reaching this point of operations, it will remain constant and the angular adjustment of the guide blades of the turbo-compressor 7 will then start. At approximately 50% of the rated load, the adjustment of the guide blades has also reached its maximum. From here on out the quantity of air will remain constant and the excess air amount will increase in accordance with any further decrease in the quantity of fuel.

It would be a mistake, in the case of a dropping load, to adjust first the guide blades of the compressor and then to lower the r.p.m. because this procedure would have the result that the region of the low gradient characteristic of the gas turbine would be reached at the very beginning. A simultaneous adjustment of the guide blades and lowering of the r.p.m. of the charging group would also be less advantageous than the specific sequence of controls as described above. On the other hand, it would be advantageous to adjust not only the guide blades 27 but also the rotor blades 34 of the compressor 7, possibly even also the blading of the turbine, and such adjustments are illustrated in FIG. 2. Here it will be seen that the rotor blading 34 of compressor 7 is also adjustable by a mechanism 34*a* similar to that of mechanism 27*a*, and which is likewise actuated by servo piston 26*a*. The stator blading 35 of gas turbine 8 is likewise adjustable by mechanism 35*a* connected to piston 39*a* of servo-motor 39 connected to the pressurized oil line 14.

I claim:

1. Apparatus for regulating a steam power plant of the type including a pressure-fired boiler supplying steam to a turbine group, a charging group for the boiler operating at high pressure ratios, said charging group including an axial flow compressor having adjustable blading and which is driven by a gas turbine for supplying combustion air to the boiler and a speed governor, said gas turbine being driven by combustion gas discharged from the boiler such that the heat content thereof is substantially completely consumed in the turbine and the power delivered by it to the compressor, and a governor in the live steam feed line from the boiler to the steam turbine group, said regulating apparatus comprising first means responsive to a variable control signal produced by said live-steam governor in accordance with a variation in plant load for regulating fuel flow to said boiler, second means responsive to said control signal for regulating the heat content of the combustion gas flowing to said gas turbine and for regulating said speed governor, third means responsive to said control signal for adjusting the compressor blading, and means effecting a sequentially functional relationship between said second and third means such that in the case of a decrease in plant load and a resultant increase in live steam pressure, first the speed of said charging group is decreased to and held at a predetermined value by a reduction in the heat content of the combustion gas flowing to said gas turbine followed by an adjustment of the compressor blading in a direction to reduce its air throughput with the speed of said charging group being held constant at said decreased predetermined value, whereas in the case of an increase in plant load and a resultant decrease in live-steam pressure, first said compressor blading is adjusted in a direction to increase its air throughput followed by an increase in the heat content of the combustion gas flowing to said gas turbine and hence an increase in speed of said charging group.

2. Apparatus as defined in claim 1 for regulating a steam power plant wherein the stator blading of said compressor is adjustable by said third means.

3. Apparatus as defined in claim 1 for regulating a steam power plant wherein both the stator and rotor blading of said compressor are adjustable by said third means.

4. Apparatus as defined in claim 1 for regulating a steam power plant wherein the stator blading of said gas turbine is also adjustable and which further includes fourth means responsive to said control signal for adjusting the same.

* * * * *